US007581810B2

(12) United States Patent
Yoshikawa et al.

(10) Patent No.: US 7,581,810 B2
(45) Date of Patent: Sep. 1, 2009

(54) INKJET RECORDING APPARATUS AND MAINTENANCE METHOD THEREOF

(75) Inventors: Hirokazu Yoshikawa, Kawasaki (JP); Hiroshi Tajika, Kawasaki (JP); Hitoshi Nishikori, Inagi (JP); Daisaku Ide, Meguro (JP); Takeshi Yazawa, Yokohama (JP); Atsuhiko Masuyama, Shinagawa-Ku (JP); Akiko Maru, Kawasaki (JP); Hideaki Takamiya, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 216 days.

(21) Appl. No.: 11/065,215

(22) Filed: Feb. 24, 2005

(65) Prior Publication Data

US 2005/0190226 A1 Sep. 1, 2005

(30) Foreign Application Priority Data

Feb. 27, 2004 (JP) ..... 2004-053236

(51) Int. Cl.
*B41J 2/165* (2006.01)

(52) U.S. Cl. ..... 347/23

(58) Field of Classification Search ..... 347/23
See application file for complete search history.

(56) References Cited

U.S. PATENT DOCUMENTS 6,648,447 B2 * 11/2003 Sugimoto et al. ..... 347/30
2004/0165030 A1 * 8/2004 Sakamoto et al. ..... 347/23

FOREIGN PATENT DOCUMENTS

JP 07-125228 A 5/1995

* cited by examiner

*Primary Examiner*—Julian D Huffman
(74) *Attorney, Agent, or Firm*—Canon USA Inc IP Div

(57) ABSTRACT

For a recording apparatus capable of supplying a plurality of different color inks to a plurality of recording element substrates, when a condition for performing maintenance on a first recording element substrate is met, it is determined whether or not to perform maintenance on a second recording element substrate according to how close the second recording element substrate is to meeting the condition. Since maintenance is performed on the first and second recording element substrates in such a manner, unnecessary maintenance operations will be prevented from being carried out multiple times within a short period of time. Accordingly, the total amount of time required for maintenance is reduced.

4 Claims, 10 Drawing Sheets

FIG. 6

| RECORDING HEAD (1) (OR (2)) | RECORDING HEAD (2) (OR (1)) (DOT-COUNT THRESHOLD VALUE) | SUCTION METHOD |
|---|---|---|
| SUCTION FLAG ON DOT-COUNT REPLACE TANK DRIVER UI COMMAND | 100% SUCTION FLAG ON | SUCK TWO CAPS SIMULTANEOUSLY (OR IN SEQUENCE) |
| | 90% OR MORE | SUCK TWO CAPS SIMULTANEOUSLY (OR IN SEQUENCE) |
| | 90% OR LESS | SUCK ONE CAP |
| | 100% SUCTION FLAG ON | SUCK TWO CAPS SIMULTANEOUSLY (OR IN SEQUENCE) |
| | 90% OR MORE | SUCK TWO CAPS SIMULTANEOUSLY (OR IN SEQUENCE) |
| | 90% OR LESS | SUCK ONE CAP |
| | 100% SUCTION FLAG ON | SUCK TWO CAPS SIMULTANEOUSLY (OR IN SEQUENCE) |
| | 90% OR MORE | SUCK TWO CAPS SIMULTANEOUSLY (OR IN SEQUENCE) |
| | 90% OR LESS | SUCK ONE CAP |

FIG. 8

| FIG. 8A |
| --- |
| FIG. 8B |
| FIG. 8C |

FIG. 8A

| RECORDING HEAD (1) (DOT-COUNT THRESHOLD VALUE) | RECORDING HEAD (2) (DOT-COUNT THRESHOLD VALUE) | RECORDING HEAD (3) (DOT-COUNT THRESHOLD VALUE) | SUCTION METHOD |
| --- | --- | --- | --- |
| SUCTION FLAG ON DOT-COUNT REPLACE TANK DRIVER UI COMMAND | NUMBER OF DOTS (A) 100% ACHIEVED SUCTION FLAG ON | 100% SUCTION FLAG ON | SUCK THREE HEADS SIMULTANEOUSLY (OR IN SEQUENCE) |
| | | 90% OR MORE | SUCK THREE HEADS SIMULTANEOUSLY (OR IN SEQUENCE) |
| | | 90% OR LESS | SUCK HEADS (1) AND (2) SIMULTANEOUSLY (OR IN SEQUENCE) |
| | DOT-COUNT (A) 90% OR MORE | 100% SUCTION FLAG ON | SUCK THREE HEADS SIMULTANEOUSLY (OR IN SEQUENCE) |
| | | 90% OR MORE | SUCK THREE HEADS SIMULTANEOUSLY (OR IN SEQUENCE) |
| | | 90% OR LESS | SUCK HEADS (1) AND (2) SIMULTANEOUSLY (OR IN SEQUENCE) |
| | DOT-COUNT (A) 90% OR LESS | 100% SUCTION FLAG ON | SUCK HEADS (1) AND (3) SIMULTANEOUSLY (OR IN SEQUENCE) |
| | | 90% OR MORE | SUCK HEADS (1) AND (3) SIMULTANEOUSLY (OR IN SEQUENCE) |
| | | 90% OR LESS | SUCK ONLY HEAD (1) |

FIG. 8B

| | | | |
|---|---|---|---|
| 100% SUCTION FLAG ON | SUCTION FLAG ON<br>DOT-COUNT<br>REPLACE TANK<br>DRIVER UI COMMAND | DOT-COUNT (B)<br>100% ACHIEVED<br>SUCTION FLAG ON | SUCK THREE HEADS SIMULTANEOUSLY (OR IN SEQUENCE) |
| 90% OR MORE | | | SUCK THREE HEADS SIMULTANEOUSLY (OR IN SEQUENCE) |
| 90% OR LESS | | | SUCK HEADS (2) AND (3) SIMULTANEOUSLY (OR IN SEQUENCE) |
| 100% SUCTION FLAG ON | | DOT-COUNT (B)<br>90% OR MORE | SUCK THREE HEADS SIMULTANEOUSLY (OR IN SEQUENCE) |
| 90% OR MORE | | | SUCK THREE HEADS SIMULTANEOUSLY (OR IN SEQUENCE) |
| 90% OR LESS | | | SUCK HEADS (2) AND (3) SIMULTANEOUSLY (OR IN SEQUENCE) |
| 100% SUCTION FLAG ON | | DOT-COUNT (B)<br>90% OR LESS | SUCK HEADS (1) AND (2) SIMULTANEOUSLY (OR IN SEQUENCE) |
| 90% OR MORE | | | SUCK HEADS (1) AND (2) SIMULTANEOUSLY (OR IN SEQUENCE) |
| 90% OR LESS | | | SUCK ONLY HEAD (2) |

FIG. 8C

| | | | |
|---|---|---|---|
| DOT-COUNT (C) 100% SUCTION FLAG ON | 100% SUCTION FLAG ON | SUCTION FLAG ON DOT-COUNT REPLACE TANK DRIVER UI COMMAND | SUCK THREE HEADS SIMULTANEOUSLY (OR IN SEQUENCE) |
| | 90% OR MORE | | SUCK THREE HEADS SIMULTANEOUSLY (OR IN SEQUENCE) |
| | 90% OR LESS | | SUCK HEADS (1) AND (3) SIMULTANEOUSLY (OR IN SEQUENCE) |
| DOT-COUNT (C) 90% OR MORE | 100% SUCTION FLAG ON | | SUCK THREE HEADS SIMULTANEOUSLY (OR IN SEQUENCE) |
| | 90% OR MORE | | SUCK THREE HEADS SIMULTANEOUSLY (OR IN SEQUENCE) |
| | 90% OR LESS | | SUCK HEADS (1) AND (3) SIMULTANEOUSLY (OR IN SEQUENCE) |
| DOT-COUNT (C) 90% OR LESS | 100% SUCTION FLAG ON | | SUCK HEADS (2) AND (3) SIMULTANEOUSLY (OR IN SEQUENCE) |
| | 90% OR MORE | | SUCK HEADS (2) AND (3) SIMULTANEOUSLY (OR IN SEQUENCE) |
| | 90% OR LESS | | SUCK ONLY HEAD (3) |

INKJET RECORDING APPARATUS AND MAINTENANCE METHOD THEREOF

BACKGROUND OF THE INVENTION

1. Field of the Invention

The present invention relates to an inkjet recording apparatus for forming an image by using a recording head capable of discharging ink and, more specifically, relates to an inkjet recording apparatus capable of restoring a recording head and a maintenance method thereof.

2. Description of the Related Art

Along with recent wide use of information processors, such as personal computers, recording apparatuses used as image forming terminals have rapidly been improved and put to wide use. Among the various recording apparatuses, the recording apparatus most widely used by individual users is an inkjet recording apparatus. The inkjet recording apparatus prints images on recording media, such as paper, fabric, plastic sheets, and overhead projector (OHP) sheets, by discharging ink from ink outlets. The inkjet recording apparatus is in wide use because inkjet recording is significantly advantageous in that it is a low-noise and non-impact recording method, is easily applicable to color recording, and is low cost.

Basically, an inkjet recording apparatus records images by reproducing colors by subtractive color mixing using yellow ink, magenta ink, and cyan ink, which are the three primary colors of ink used in printing. More specifically, by mixing yellow ink and magenta ink, images in the orange or red color region can be reproduced. Similarly, by mixing yellow ink and cyan ink, the green region can be reproduced, and by mixing magenta ink and cyan ink, the blue or violet region can be reproduced.

The advancement in inkjet recording technology has improved the resolution, quality, and color of the recorded images, while reducing the cost. Along with the popularization of personal computers and digital cameras (including individual computers, digital cameras, and other integrated devices that have multiple functions in addition to the function as a computer or a digital camera, such as a cellular phone), inkjet recording apparatuses have greatly contributed to popularizing the use of recording apparatuses to individual users. However, such wide use of inkjet recording apparatuses has brought about a demand for improvements in the quality of the reproduced images. In order to respond to such demands from individual users, various improvements have been made.

For example, the contrast of the reproduced image has been improved and the reproduction of intermediate colors has been stabilized by applying an under color removal (UCR) process. In the UCR process, black (K) color components included in the color data for yellow (Y), magenta (M), and cyan (C) are extracted and replaced with black ink, which is used in addition to the three primary colors of ink, and the color components for Y, M, and C replaced by black ink are removed. Moreover, the graininess of the ink dots discharged onto a recording medium has been reduced, and the color gradation has been improved by using light cyan and light magenta ink in addition to yellow, magenta, cyan, and black ink.

Ink is composed of a color material such as dye or pigment. In particular, dye is superior in reproducing colors having high brightness.

In general, the recording head of an inkjet recording apparatus includes arrays of minute ink outlets. The ink outlets clog when unwanted materials, such as paper powder and dust, attach to the ink outlet unit or when ink dries and thickens and sticks to the ink outlet unit. As a result of clogging, the ink outlets discharge ink unsuccessfully (or even worse, will completely fail to discharge ink). Moreover, when an ink cartridge is used to supply ink to a brand-new recording head or when a brand-new recording head cartridge including an ink cartridge and a recording head is used, the ink channels and the ink outlets may not be in a satisfactory condition for discharging ink successfully since the ink channels, from the ink outlets of the recording head to the ink cartridge, are not filled with ink. Therefore, to clear clogging and to normalize the condition of ink channels, cleaning means for removing unwanted materials on the ink outlet unit (i.e. a surface of the recording head where ink outlets are formed. Hereinafter this surface is referred to as an 'outlet surface') and restoring means for normalizing the ink outlets and the ink channels of the recording head are provided.

Cleaning means is a mechanism for wipe-cleaning the outlet surface of the recording head with a flexible wiper. Restoring means includes a cap for covering the outlet surface and a pump that communicates with the cap and sucks out ink from inside the cap and the recording head. This structure of the restoring means enables preliminary discharge of ink from the ink outlets toward the cap by driving energy-generating elements disposed inside the ink outlets and restoration of the ink outlets by forcing the ink out of the ink outlets by contacting the cap with the outlet surface and sucking out the ink inside the recording head by suction force (negative pressure) generated by the pump. Preliminary discharge fills the ink channels and the recording head with ink, and restoration of ink outlets by suction removes dust and thickened ink from the recording head. As a result, the discharge of ink is maintained in good condition by eliminating the causes of ink discharge failure. Moreover, to reduce the possibility of ink discharge failure, the cap covers the ink outlets when the recording head is at a home position when recording is not carried out.

As the number of ink outlets increases, unwanted material is more likely to attach to the outlet surface. Therefore, it is desirable to perform restoration of the ink outlets to suck out unwanted ink and wipe-clean the outlet surface. However, if restoration of the ink outlets is performed more often than necessary, electricity consumption increases. Furthermore, wipe-cleaning interrupts the recording operation and, if performed more often than necessary, throughput decreases.

To prevent restoration by suction and wipe-cleaning to be carried out more often than necessary, known inkjet recording apparatuses count the number of discharges performed by the ink outlets and carry out restoration by suction and wipe-cleaning only when the number of discharges exceed a predetermined threshold value. As disclosed in Japanese Patent Laid Open No. 07-125228, a technology that enables wiping to be carried out for a suitable number of times by measuring the number of discharges and the duration of printing time and comparing these measured values with threshold values for measured values has been proposed. By counting the number of ink discharges in this way, the amount of ink remaining in the ink tank can also be calculated.

Recently, to form high quality images, a recording apparatus that uses other color inks in addition to cyan, magenta, yellow, and black (for example, red, green, and blue ink) and other liquids that become insoluble when mixed with ink have been proposed. However, as the number of different color inks and different types of liquids discharged from the recording head increases, the number of arrays of ink outlets has also increased. As a result, if all necessary arrays of ink outlets are formed on one recording element (semiconductor chip) as in known recording apparatuses, the recording element substrate becomes large and the cost for producing this recording element substrate without any defects becomes high.

A recording apparatus capable of forming high quality images using a known recording element substrate by providing two recording heads or by providing two recording element substrates on one recording head is known.

However, for a recording apparatus having two recording heads and two caps corresponding to the recording heads, if the number of discharges from a first recording heads exceeds a predetermined threshold value and the number of discharges from a second recording head is just below the predetermined threshold value, a suction flag is set for only the first recording head. Thus, restoration of the ink outlets by suction is carried out on only the first recording head having set a suction flag. Then, if recording is performed for a short time after the restoration of the first recording head, the second recording head will set a suction flag and restoration will be carried out for the second recording head. In other words, restoration is carried out two times within a short period of time, taking up time for maintaining the recording head and reducing throughput. Moreover, since the restoration operation is carried out twice, the waiting time for completing the recording becomes longer and a large amount of ink may be sucked away, causing inconvenience to users.

SUMMARY OF THE INVENTION

The present invention is directed to an inkjet recording apparatus capable of supplying a plurality of different color inks to a plurality of recording element substrates, wherein multiple maintenance operations are prevented from being performed in a short time period so as to reduce time required for maintenance and to increase throughput. The present invention is also directed to a method for maintaining the inkjet recording apparatus.

In one aspect of the present invention, an inkjet recording apparatus includes a recording head, a restoration unit, and a restoration controlling unit. The recording head includes a plurality of nozzle arrays including first and second nozzle-arrays configured to discharge a liquid that corresponds respectively. The restoration unit is configured to independently restore the first and second nozzle-arrays so as to maintain a discharge condition of the first and second nozzle arrays. The restoration controlling unit determines whether first and second conditions are satisfied. Responsive to determining that the first condition is satisfied, the restoration controlling unit controls the restoration unit to restore the first nozzle-array. Responsive to determining that the first and second conditions are satisfied, the restoration controlling unit controls the restoration unit to restore the first and second nozzle arrays.

In another aspect of the present invention, a method for maintaining the above-described inkjet recording apparatus is provided. The method includes a first determination step of determining whether or not a first condition is satisfied with respect to the first nozzle array; a second determination step of determining whether or not a second condition is satisfied with respect to the second nozzle array responsive to determining in the first determination step that the first condition is satisfied; a first restoration step of restoring the first nozzle array responsive to determining in the first determination step that the first condition is satisfied; and a second restoration step of restoring the second nozzle array responsive to determining in the second determination step that the second condition is satisfied.

According to the present invention, when a condition for performing maintenance on a first recording element substrate is met, it is determined whether or not to perform maintenance on a second recording element substrate according to how close the second recording element substrate meets the condition. Since maintenance is performed on the first and second recording element substrates in such a manner, unnecessary maintenance operations will be prevented from being carried out multiple times within a short period of time. Accordingly, the total amount of time required for maintenance is reduced. Moreover, throughput is improved.

Further features and advantages of the present invention will become apparent from the following description of exemplary embodiments (with reference to the attached drawings).

BRIEF DESCRIPTION OF THE DRAWINGS

FIG. 6 is a table showing combinations of suction processes according to the first embodiment of the present invention.

FIGS. 8A-C show a table of combinations of suction processes according to the second embodiment of the present invention.

DESCRIPTION OF THE EMBODIMENTS

Embodiments of the present invention are described below with reference to the drawings.

First Embodiment

Structure

Figure 1:
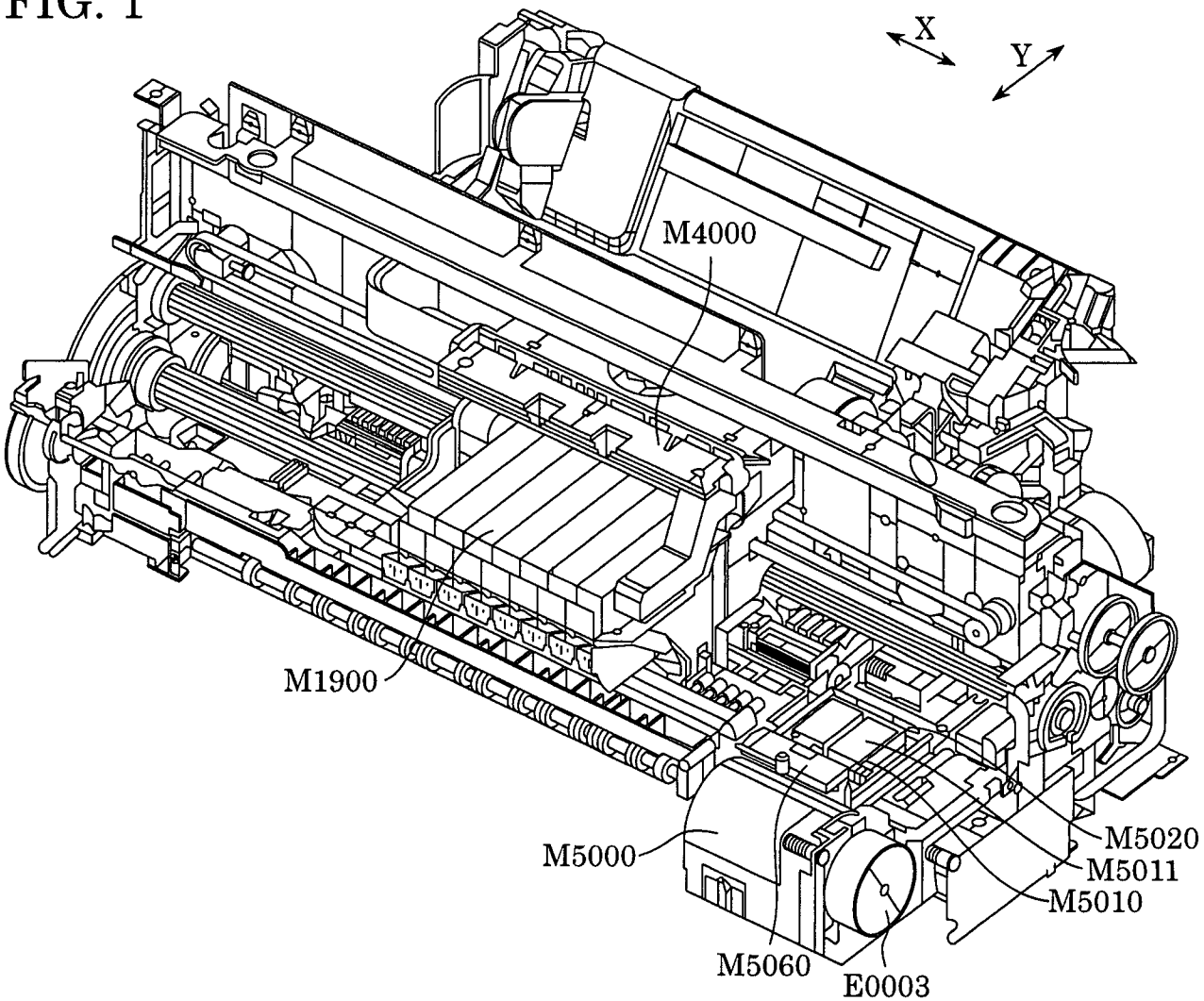
FIG. 1 is a perspective view of an inkjet recording apparatus according to the present invention.
Figure 2:
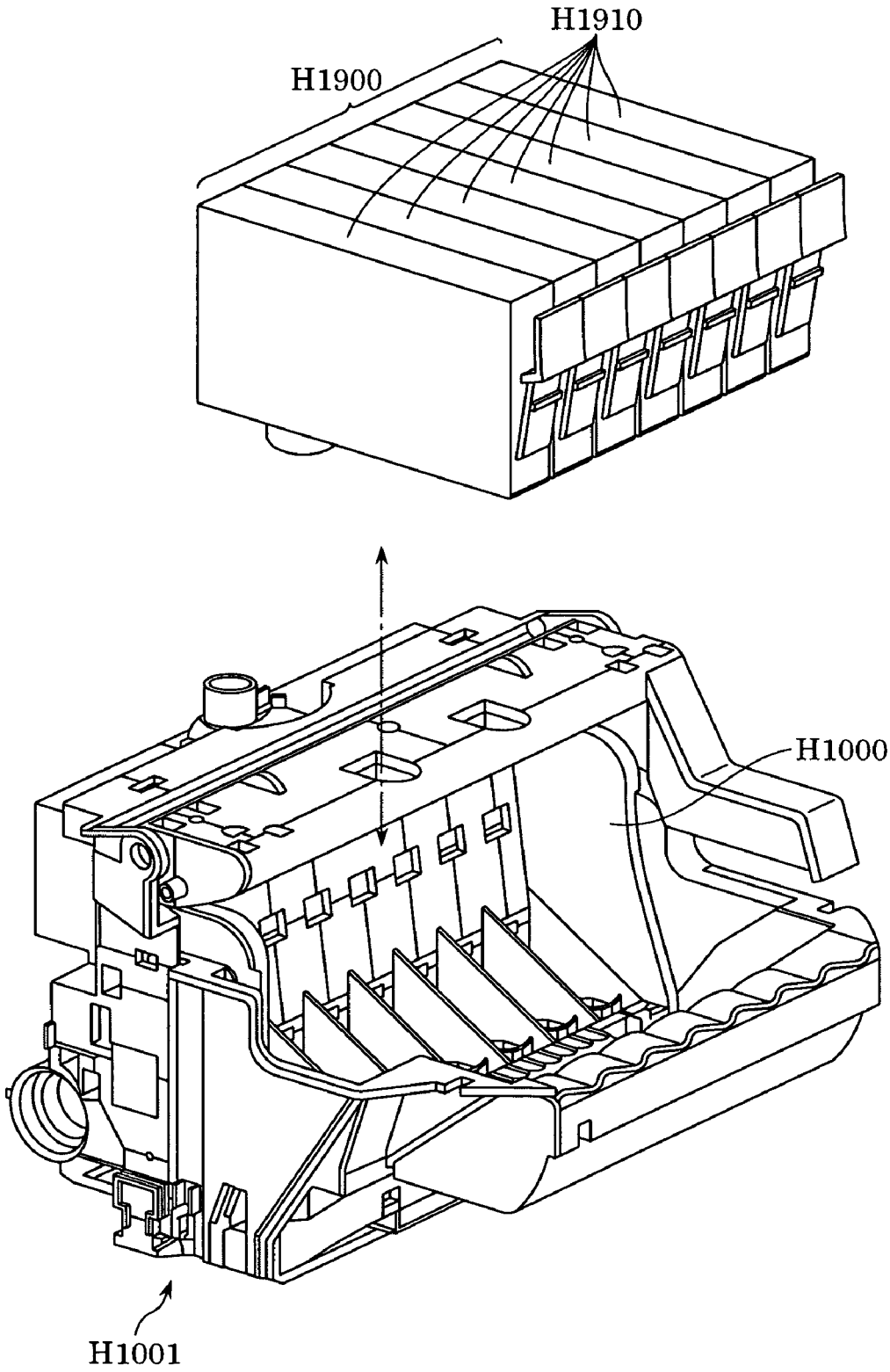
FIG. 2 is a perspective view of an ink tank attached to a head cartridge according to the present invention.

The structure of a recording apparatus according to this embodiment will be described below. The main body of the recording apparatus according to this embodiment includes a paper feeding unit, a paper delivery unit, a paper ejecting unit, a carriage unit, a cleaning unit, and an exterior unit, wherein each part is grouped by its function. The present invention relates to a suction process for restoration. Now the cleaning unit will be described below. FIG. 1 is a perspective view of an inkjet recording apparatus according to the present invention. FIG. 2 is a perspective view of an ink tank attached to a head cartridge according to the present invention.

(Cleaning Unit)

The cleaning unit includes a pump M5000 for cleaning a recording head H1001, a cap M5010 for preventing the recording head H1001 from drying out, and blades M5020 for cleaning an outlet surface of the recording head H1001. The blades M5020 include a plurality of blades for cleaning the vicinity of nozzles on the recording head H1001 and for cleaning the entire face of the recording head H1001.

A cleaning motor E0003 used exclusively for the cleaning unit is provided in the cleaning unit. The cleaning motor E0003 has a one-way clutch (not shown in the drawings) so that, when the cleaning motor E0003 rotates in a first direction, the pump M5000 is operated and, when the cleaning motor E0003 rotates in a second direction, the blades M5020 are operated simultaneously as the cap M5010 is moved up and down.

The pump M5000 generates a negative pressure by squeezing a tube (not shown in the drawings) with two pump rollers (also not shown in the drawings). The cap M5010 is connected to the pump M5000 via a valve (not shown in the drawings). By operating the pump M5000 while the cap M5010 is in contact with an ink outlet of the recording head H1001, negative pressure is applied to the inside of the recording head H1001, causing unwanted ink to be sucked out from the inside of the recording head H1001. On the inside of the cap M5010, an absorber M5011 is provided so as to absorb and reduce the amount of residual ink on the face of the recording head H1001 after the ink is sucked out. Furthermore, residual ink on the cap M5010 is sucked away while the cap M5010 is open so as to prevent contamination by residual ink and to prevent other adverse effects caused by the residual ink. The waste ink sucked out by the pump M5000 is absorbed and collected by a waste ink absorber provided on the lower case.

The series of continuous operations including operation of the blades M5020, rising and lowering of the cap M5010, and opening and closing of the valve are controlled by a main cam (not shown in the drawings) including a plurality of cams provided on a shaft. The main cam operates the cams and arms to carry out predetermined operations. The position of the main cam can be detected by a position detection sensor (not shown), such as a photo interrupter. When the cap M5010 is lowered, the blades M5020 move in a direction orthogonal to the scanning direction (i.e., secondary scanning direction) of a carriage M4000 so as to clean the face of the recording head H1001. When the carriage M4000 moves to an inner most position, ink attached to the blades M5020 is removed as the blades M5020 come into contact with a blade cleaner M5060.

(Structure of Recording Head)

The structure of a head cartridge H1000 according to this embodiment will be described below. The head cartridge H1000 according to this embodiment includes the recording head H1001, a mechanism for installing an ink tank H1900, and a mechanism for supplying ink from the ink tank H1900 to the recording head H1001. The head cartridge H1000 is detachable from the carriage M4000.

FIG. 2 illustrates the head cartridge H1000 according to this embodiment in which the ink tank H1900 can attached thereto. The recording apparatus according to this embodiment forms images using seven different color inks. Accordingly, the ink tank H1900 has seven independent compartments H1910 for each color ink. As illustrated in the drawing, each compartment H1910 of the ink tank H1900 is detachable from the head cartridge H1000. The ink tank H1900 can be removed from or installed to the head cartridge H1000 while the head cartridge H1000 is installed on the carriage M4000.

Figure 3:
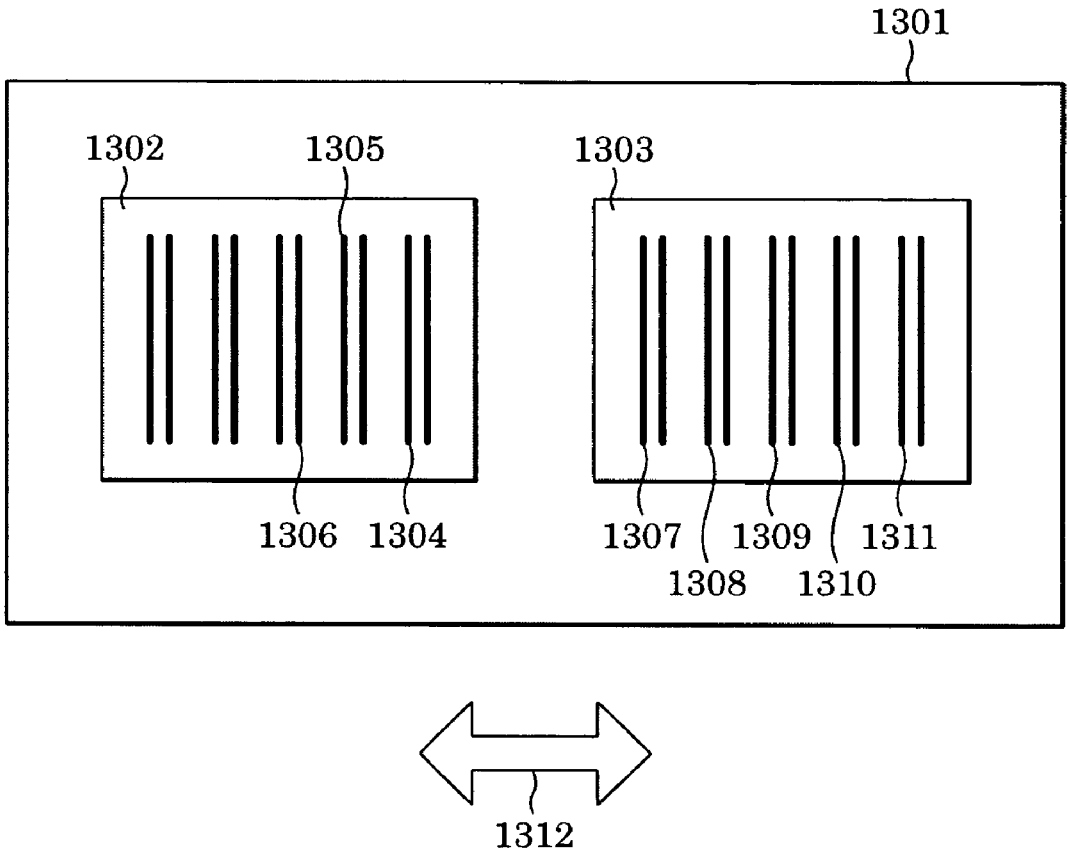
FIG. 3 is a schematic view of nozzles of an inkjet head according to the present invention.

FIG. 3 is a schematic view of nozzles of an inkjet head according to the first embodiment of the present invention.

An inkjet head 1301 includes a first recording element substrate 1302 for high-speed full color recording and a second recording element substrate 1303 for high-quality recording.

The first recording element substrate 1302 for high-speed full color recording supports cyan, magenta, and yellow ink, which are the three primary colors of the color material of ink for reproducing a full range of colors by subtractive color mixing. Nozzles 1304, 1305, and 1306 for discharging the three different color inks are aligned in the delivery direction, or, in other words, a direction substantially orthogonal to the scanning direction of the inkjet head (indicated by a double-headed arrow 1312). A pair of nozzles aligned in parallel is provided for each color ink. Furthermore, additional pairs of nozzles 1304 and 1305 are provided on the first recording element substrate 1302. Accordingly, the first recording element substrate 1302 for high-speed full color recording includes one pair of nozzles 1306 and two pairs of nozzles 1304 and 1305. The nozzles included in the first recording element substrate 1302 are arranged symmetrically along the scanning direction 1312 with respect to the nozzles 1306.

The second recording element substrate 1303 for high-quality recording includes pairs of nozzles 1307 and 1311 for discharging light cyan ink and light magenta ink, respectively, so as to improve the gradation of an output image. Furthermore, a pair of nozzles 1309 for discharging black ink is provided so as to improve the contrast of an output image. In addition, on the second recording element substrate 1303 according to this embodiment, pairs of nozzles 1308 and 1310 for discharging two types of special ink (special ink 1 and special ink 2) are provided so as to reproduce colors that cannot be reproduced by using only the three primary colors (cyan, magenta, and yellow) of the color material of ink. Similar to the first recording element substrate 1302, the nozzles 1307 to 1311 provided on the second recording element substrate 1303 are provided in pairs.

The arrays of recording elements (hereinafter also referred to as 'nozzle arrays') corresponding to each different color ink includes 768 nozzles aligned in the delivery direction of a recording medium at intervals of about 1,200 dots per inch (dpi). Each nozzle discharges about 2 pico-litters of ink. The size of the nozzle outlet is about 100 μm (Maintenance System)

Figure 4:
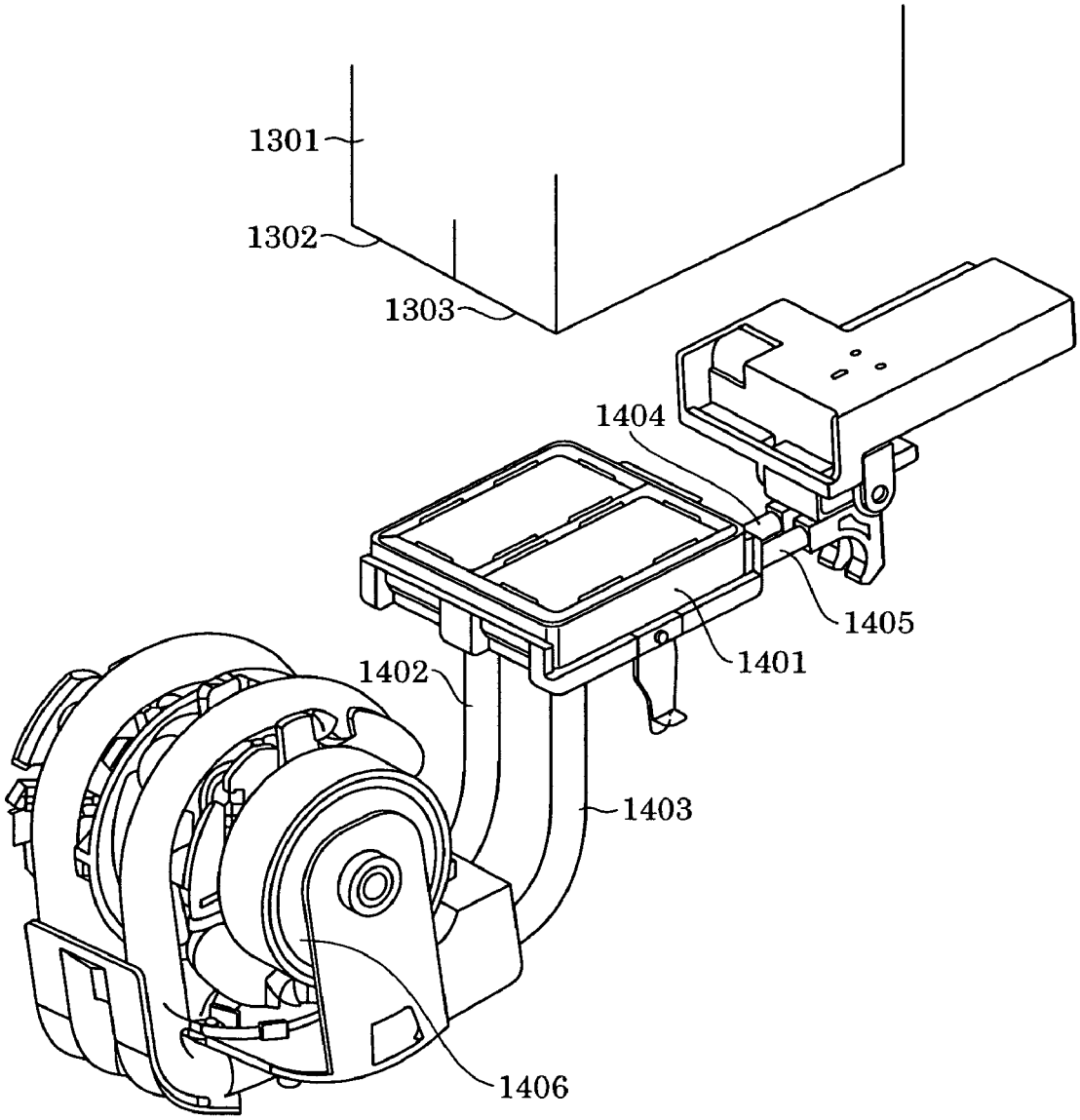
FIG. 4 is a perspective view of a maintenance system of the inkjet recording apparatus according to the present invention.

FIG. 4 is a perspective view of a maintenance system of the inkjet recording apparatus according to this embodiment.

A suction cap 1401 includes two compartments for covering the first and second recording element substrates 1302 and 1303. The suction cap 1401 comes in contact with or presses against the surface of the nozzles of the recording element substrates 1302 and 1303. Ink absorbers are disposed inside the suction cap 1401. In each compartment of the suction cap 1401, open valves 1404 and 1405 are provided. Ink draining tubes 1402 and 1403, independent from each other, are connected to each compartment of the suction cap 1401. The recording apparatus according to this embodiment only includes one pump 1406 for both of the ink draining tubes 1402 and 1403 because, if two independent pumps are provided for the ink draining tubes 1402 and 1403, it is disadvantageous in that the area to be covered for maintenance increases, the size of the apparatus becomes large, and the production cost of the apparatus becomes high. In other words, the open valves 1404 and 1405 and the ink draining tubes 1402 and 1403 are provided for each independent compartment of the suction cap 1401 but the pump 1406 is used commonly for the open valves 1404 and 1405 and the ink draining tubes 1402 and 1403. When restoring the inkjet head 1301 by suction, the open valve of the compartment of the suction cap corresponding to the recording element substrate that requires restoration may be closed and the other open valve of the compartment of the suction cap corresponding to the recording element substrate that does not require restoration may be open. In this way, the recording element substrates can be selectively restored.

According to this embodiment, the operation referred to as 'suction' is to suck ink out from the suction cap 1401 or the nozzles of the first recording element substrate 1302 by rotating the pump 1406 while the surface of the first recording element substrate 1302 including the outlets is covered with the suction cap 1401 and the open valve (also referred to as an 'air communication valve') corresponding to the first recording element substrate 1302 is closed. The ink outlets of the first recording element substrate 1302 are maintained in a good discharge condition. The suction is performed on the second recording element substrate 1303 in the same manner. In FIG. 4, the suction cap 1401 covers the first and second recording element substrate 1302 and 1303. However, two suction caps may be provided to cover each recording element substrate separately.

By changing the rotational amount and the rotational speed of the pump 1406, the negative pressure applied to the inkjet head 1301 can be changed. Consequently, the amount of ink to be sucked out of the inkjet head can be changed. Moreover, it is possible to change the amount of ink to be sucked out of the inkjet head by changing the length of time of operating the pump 1406.

Figure 5:
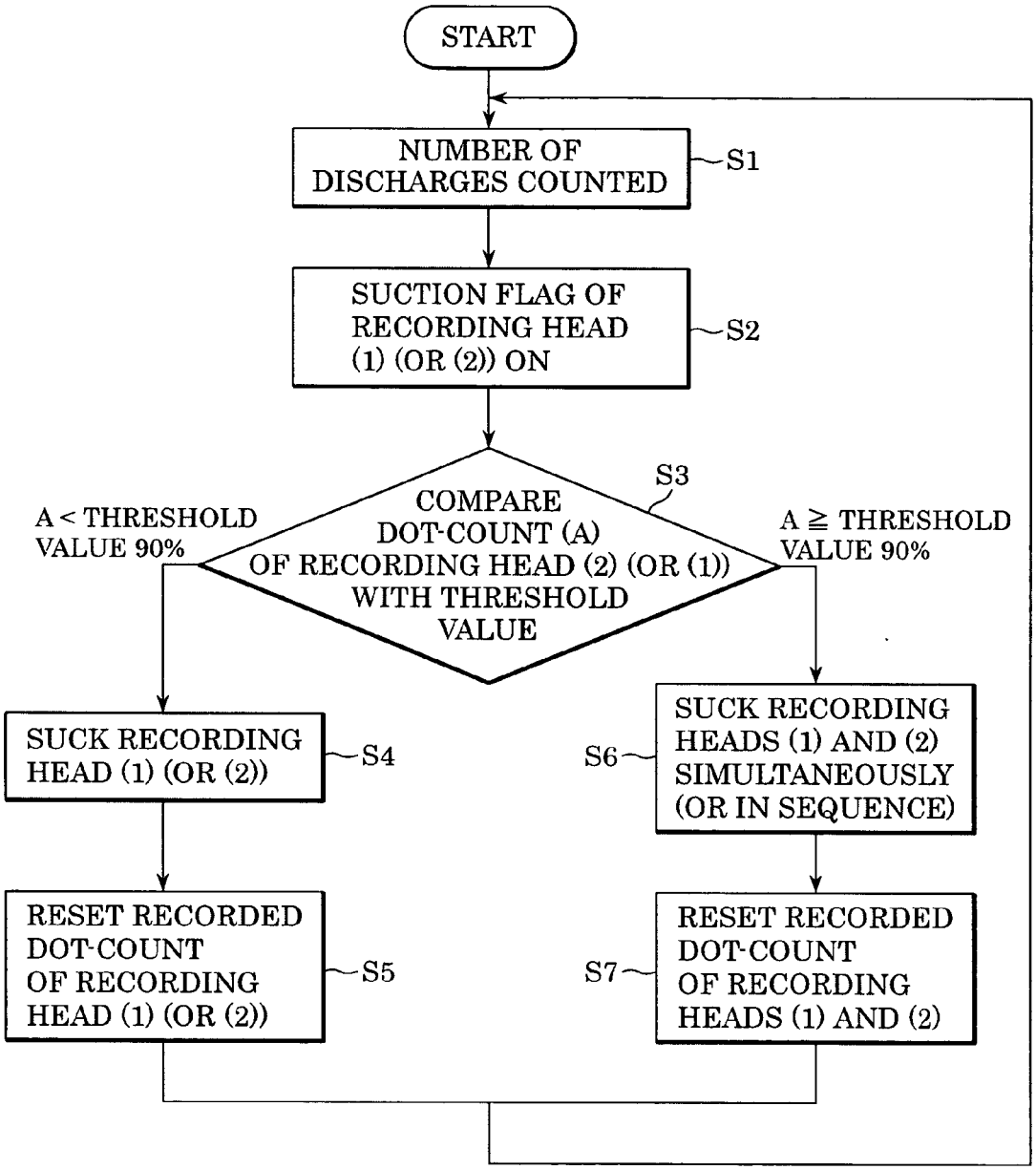
FIG. 5 is a flow chart illustrating a suction process according to a first embodiment of the present invention.

FIG. 5 is a flow chart illustrating the suction process according to the first embodiment of the present invention. FIG. 6 is a table showing the restoration methods corresponding to the number of discharges made by the recording heads.

The suction operation will be described with reference to the flow chart in FIG. 5.

As recording begins, the number of ink droplets (number of discharges) discharged from the ink outlets of the recording head H1001 are counted (Step S1). The number of discharges performed is also referred to as 'dot-count.' At this time, the number of discharges made from each of the recording element substrates 1302 and 1303 are counted separately. The number of discharges made by the first recording element substrate 1302 (hereinafter referred to as 'recording head 1') or the second recording element substrate 1303 (hereinafter referred to as 'recording head 2') is compared with a predetermined threshold value (e.g., In a case of an inkjet head in which one ejection port ejects 2 pl/dot, the dot count value is compared with a predetermined threshold value of $2*10^8$). If the dot-count has reached 100% of the threshold value, a suction flag is set for the recording head that has reached 100% of the threshold value (Step S2). At this time, data (flag) indicating that restoration by suction is to be carried out on the recording head that has reached 100% of the threshold value is written into a memory. A suction flag will be set even when the dot-count has not reached the threshold value, if the amount of ink in the ink tank is low, if the ink tank has run out of ink and must be replaced, or if a user uses a user interface (UI) of a printer driver installed in the host apparatus to command restoration of the recording head. The suction flag is set when these states are confirmed.

Subsequently, the dot-count of the recording head in which a suction flag that was not set in Step S2 is compared with the threshold value (Step S3). If a suction flag is set for recording head 1, the dot-count A of the recording head 2 is compared with the threshold value. If a suction flag is set for recording head 2, the dot-count A of the recording head 1 is compared with the threshold value.

If the dot-count A obtained in Step S3 is 90% or less of the threshold value, suction is performed on the recording head in which a suction flag is set (Step S4). Then, the dot-count A of the recording head that has been sucked is reset (Step S5). As recording begins, ink dot-counting begins again (Step S1).

If the dot-count A obtained in Step S3 is 90% or more of the threshold value, a suction flag is set for the recording head that does not have a suction flag set and both recording heads 1 and 2 are sucked (Step S6). Then, the dot-count A of both recording heads 1 and 2 are reset (Step S7). As recording begins, ink dot-counting begins again (Step S1). When the suction is carried out on both recording heads 1 and 2, the recording heads may be sucked simultaneously or in sequence.

When a condition for restoring a first recording head is met, the dot-count of a second recording head is referred to. Even if the dot-count of the second recording head does not reach the threshold value, restoration by suction is carried out on the second recording head, in addition to the first recording head. In this way, the frequency of performing restoration by suction is reduced and the time wasted on maintenance can be reduced. In other words, it is determined whether or not the number of discharges made by the recording head that has not met the condition for restoration meets another predetermined condition before it meets the condition for restoration. Then, restoration is carried out in accordance with whether or not another predetermined condition is met.

According to the flow chart in FIG. 5, a restoration flag is set when the dot-count of the recording head not meeting the restoration condition is 90% or more of the threshold value. However, this value may be changed depending on the ink consumption rate of each color ink and the frequency of use of the recording apparatus.

The process according to the flow chart in FIG. 5 is applied to restoration by suction. However, the process may be applied to wiping or preliminary discharge as well. Furthermore, the process may be applied to a recording apparatus having a recording head including two recording element substrates or a recording apparatus having two recording heads, each having a recording element substrate.

In Step S3 of the process illustrated in FIG. 5, the dot-count is compared with a threshold value to determine whether or not a condition for carrying out restoration by suction is met. Then, a suction flag is set in accordance with the results of Step S3. Instead, however, a suction flag may be set when the amount of ink in the ink tank is low (i.e., when the ink will run out after one more restoration operation). In this way, restoration can be carried out, and, subsequently, an indication requesting the ink tank to be replaced may be provided.

As described above, according to this embodiment, when a condition for performing maintenance on a first recording element substrate is met, it is determined whether or not to perform maintenance on a second recording element substrate according to how close the second recording element substrate is to meeting the condition. Since maintenance is performed on the first and second recording element substrates in such a manner, unnecessary maintenance operations will be prevented from being carried out multiple times within a short period of time. Accordingly, the total amount of time required for maintenance is reduced. Moreover, throughput is improved.

Second Embodiment

The maintenance control according to the first embodiment was applied to a recording head having two recording element substrates. In this embodiment, maintenance control for a recording head having three recording element substrates will be described. The structure of the inkjet recording apparatus is the same as the first embodiment, and, therefore, descriptions are omitted.

Figure 7:
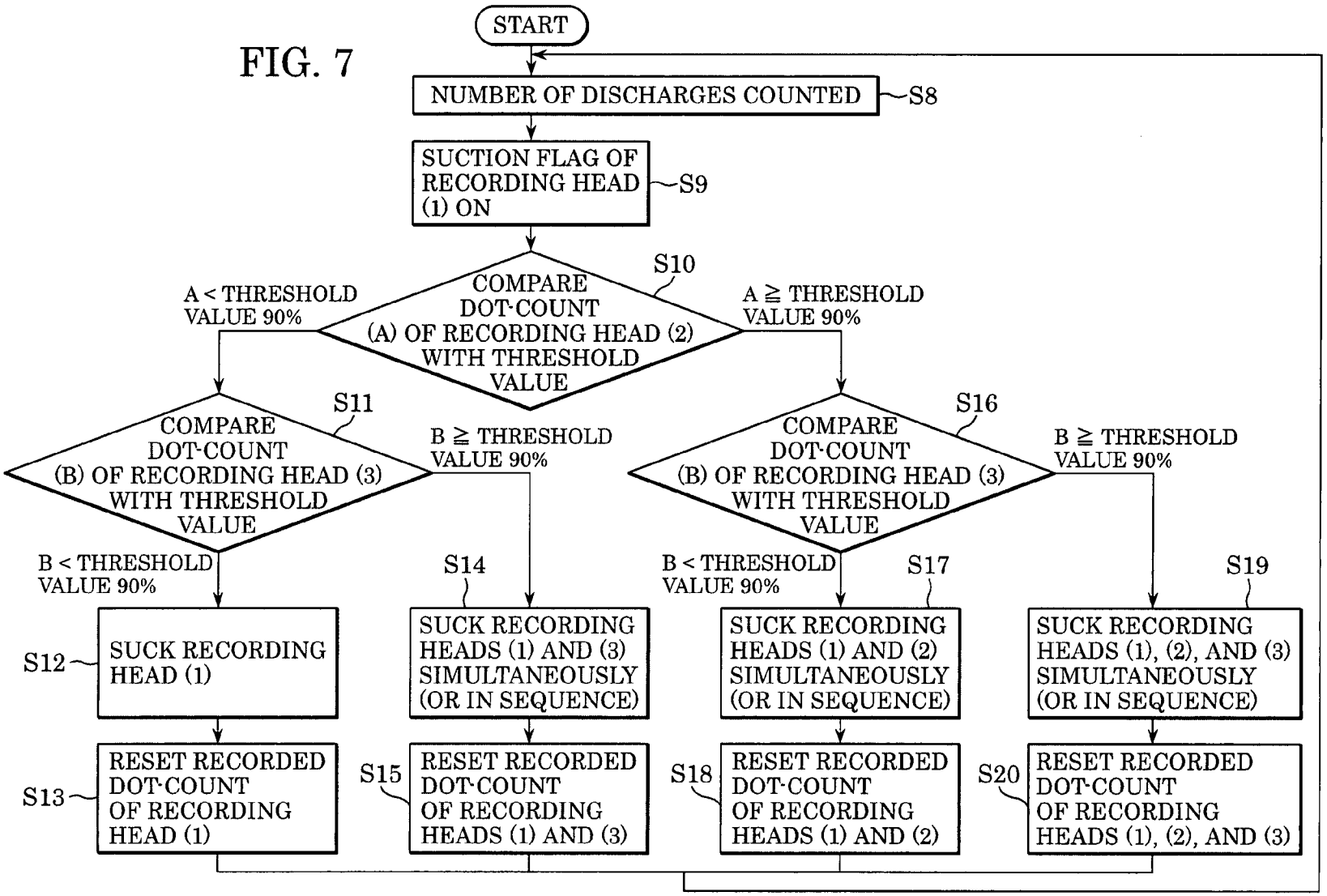
FIG. 7 is a flow chart illustrating a suction process according to a second embodiment of the present invention.

FIG. 7 is a flow chart illustrating a suction process according to the second embodiment. FIGS. 8A-C show a table of the restoration methods corresponding to the number of discharges made by the recording heads.

The suction process will be described with reference to the flow chart in FIG. 7.

As recording begins, the number of ink droplets (number of discharges) discharged from the ink outlets of the recording head H1001 are counted (Step S8). At this time, the number of discharges made by the recording element substrates 1302 and 1303 are counted separately. A suction flag is set when a restoration condition is met by the first recording element substrate (hereinafter referred to as a 'recording head 1') (Step S9). According to this embodiment, a restoration condition is met when the dot-count of the recording head 1 reaches 100% of the threshold value, when the ink in the ink tank has run out and the ink tank must be replaced, or when a user commands restoration.

Then, the dot-count A of the second recording element substrate (hereinafter referred to as a 'recording head 2') is compared with the threshold value, and a third recording element substrate (hereinafter referred to as a 'recording head 3') is compared with the threshold value (Steps S10, S11, and S16).

In Step S10, if the dot-count A of the recording head 2 is less than 90% of the threshold value and the dot-count B of the recording head 3 is less than 90% of the threshold value, a suction flag is set only for the recording head 1. Therefore, suction is carried out only on the recording head 1 (Step S12), and then, the dot-count of the recording head 1 is reset (Step S13). As recording begins, ink dot-counting begins again (Step S8).

If the dot-count A of the recording head 2 is less than 90% of the threshold value in Step S10, and the dot-count B of the recording head 3 is 90% or more of the threshold value in Step S11, a suction flag is additionally set for the recording head 3. Therefore, suction is carried out on the recording heads 1 and 3 (Step S14), and then, the dot-counts of the recording heads 1 and 3 are reset (Step S15). As recording begins, ink dot-counting begins again (Step S8).

If the dot-count A of the recording head 2 is 90% or more of the threshold value in Step S10, and the dot-count B of the recording head 3 is less than 90% of the threshold value in Step S1, a suction flag is additionally set for the recording head 2. Therefore, suction is carried out on the recording heads 1 and 2 (Step S17), and then, the dot-counts of the recording heads 1 and 2 are reset (Step S18). As recording begins, ink dot-counting begins again (Step S8).

If the dot-count A of the recording head 2 is 90% or more of the threshold value in Step S10, and the dot-count B of the recording head 3 is 90% or more of the threshold value in Step S11, a suction flag is additionally set for the recording heads 2 and 3. Therefore, suction is carried out on the recording heads 1 to 3 (Step S19), and then, the dot-counts of the recording heads 1 to 3 are reset (Step S20). As recording begins, ink dot-counting begins again (Step S8).

As described above, for an inkjet apparatus according to this embodiment including a plurality of recording element substrates capable of controlling the maintenance operation for each recording element substrate, when a condition for performing maintenance on a predetermined recording element substrate is met, it is determined whether or not to perform maintenance on the other recording element substrates (excluding the predetermined recording element) according to how close the other recording element substrates are to meeting the condition. Since maintenance is performed on the plurality of recording element substrates in such a manner, unnecessary maintenance operations will be prevented from being carried out multiple times within a short period of time. Accordingly, the total amount of time required for maintenance can be reduced. Moreover, throughput can be improved.

According to this embodiment, a restoration flag is set when the dot-count of the recording head not meeting the restoration condition is 90% or more of the threshold value. However, this value may be changed depending on the ink consumption rate of each color of ink and the frequency of use of the recording apparatus.

The process according to the flow chart in FIG. 7 is applied to restoration. However, the process may be applied to wiping or preliminary discharge as well. Furthermore, the process may be applied to a recording apparatus having a recording head including three recording element substrates, a recording apparatus having three recording heads, each having a recording element substrate, or a recording apparatus having two recording heads, each having one or two recording element substrates.

When restoration by suction is performed on two or more recording heads, the recording heads may be sucked simultaneously or in sequence.

Other Embodiments

As described above, the maintenance control methods according to the first and second embodiments were applied to an inkjet recording apparatus having a mechanism that enables each recording element substrate to be maintained independently. However, the present invention may be applied to an inkjet recording apparatus capable of performing maintenance on one recording element substrate at a time. For example, for a recording head having two recording element substrates, two caps for covering the outlet surface of each recording element substrate are provided. However, since only one cap can be used for restoration by suction for an inkjet recording apparatus that includes a pump that is connected to only one cap, only one recording element substrate can be sucked at a time. In such a case, if suction is to be performed on two recording element substrates, the recording element substrates may be sucked simultaneously or in sequence, as illustrated in Step S6 in the flow chart in FIG. 5. In this case, a driving system for covering each recording element substrate with the cap used for suction must be provided.

According to the first and second embodiments, whether or not to perform restoration is determined by counting the number of discharges made from the recording element substrates. Alternatively, whether or not to perform restoration may be determined by measuring the amount of ink discharged from the recording element substrates.

While the present invention has been described with reference to exemplary embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

This application claims priority from Japanese Patent Application No. 2004-053236 filed Feb. 27, 2004 which is hereby incorporated by reference herein.

What is claimed is:

1. A maintenance method of performing a maintenance of an inkjet recording apparatus comprising a recording unit having at least two recording element substrates, each recording element substrate having at least one recording element group configured to discharge a liquid, the method comprising:

counting, for each of the two recording element substrates, a number of discharges of the liquid from the at least one recording element group; and determining a performance of the maintenance of the two recording element substrates based on the number counted in the counting step, wherein in the determining step, (i) if the number counted for one recording element substrate of the two recording element substrates is equal to or more than a first threshold value and the number counted for another recording element substrate of the two recording element substrates is equal to or more than the first threshold value, the performance of the maintenance of the one and another recording element substrates is determined, (ii) if the number counted for the one recording element substrate is equal to or more than the first threshold value and the number counted for the another recording element substrate is less than the first threshold value and is equal to or more than a second threshold value smaller than the first threshold value, the performance of the maintenance of the one and another recording element substrates is determined, and (iii) if the number counted for the one recording element substrate is equal to or more than the first threshold value and the number counted for the another recording element substrate is less than the second threshold value, the performance of the maintenance of the one recording element substrate except for the another recording element substrate is determined.

2. The maintenance method according to claim 1, wherein the maintenance of the one recording element substrate includes a suction operation for sucking the liquid from the at least one recording element group of the one recording element substrate, and wherein the maintenance of the another recording element substrate includes a suction operation for sucking the liquid from the at least one recording element group of the another recording element substrate.

3. The maintenance method according to claim 1, wherein the one recording element substrate has at least a first recording element group configured to discharge liquid having a first color and a second recording element group configured to discharge liquid having a second color different from the first color, and wherein the another recording element substrate has at least a third recording element group configured to discharge liquid having a third color different from the first and second colors and a fourth recording element group configured to discharge liquid having a fourth color different from the first, second, and third colors.

4. A maintenance method of performing a maintenance of an inkjet recording apparatus comprising a recording unit having at least two recording element substrates, each recording element substrate having at least one recording element group configured to discharge a liquid, the method comprising:

obtaining, for each of the two recording element substrates, information indicative of an amount of the liquid discharged from the at least one recording element group; and determining a performance of the maintenance of the two recording element substrates based on the information obtained in the obtaining step;

wherein in the determining step, (i) if the amount indicated by the information obtained for one recording element substrate of the two recording element substrates is equal to or more than a first amount and the amount indicated by the information obtained for another recording element substrate of the two recording element substrates is equal to or more than the first amount, the performance of the maintenance of the one and another recording element substrates is determined, (ii) if the amount indicated by the information obtained for the one recording element substrate is equal to or more than the first amount and the amount indicated by the information obtained for the another recording element substrate is less than the first amount and is equal to or more than a second amount less than the first amount, the performance of the maintenance of the one and another recording element substrates is determined, and (ii) if the amount indicated by the information obtained for the one recording element substrate is equal to or more than the first amount and the amount indicated by the information obtained for the another recording element substrate is less than the second amount, the performance of the maintenance of the one recording element substrate except for the another recording element substrate is determined.

* * * * *